United States Patent [19]

Tse

[11] Patent Number: 4,574,864

[45] Date of Patent: Mar. 11, 1986

[54] VERTICALLY POSITIONING WINDOW SHADING SYSTEM

[76] Inventor: Brian H. Tse, G.P.O. Box 5577, Hong Kong, Hong Kong

[21] Appl. No.: 650,092

[22] Filed: Sep. 13, 1984

[51] Int. Cl.[4] ..... A47G 5/02

[52] U.S. Cl. ..... 160/259; 160/279

[58] Field of Search ..... 160/258, 259, 265, 279

[56] References Cited

U.S. PATENT DOCUMENTS

| | | | |
|---|---|---|---|
| 394,727 | 12/1888 | Thiel . | |
| 640,291 | 1/1900 | Forsyth | 160/265 |
| 785,806 | 3/1905 | Hopkins . | |
| 938,207 | 10/1909 | Brown . | |
| 978,260 | 12/1910 | Agersburg et al. . | |
| 1,303,678 | 5/1919 | Joseph | 160/258 |
| 4,202,395 | 5/1980 | Heck et al. | 160/84 |
| 4,326,577 | 4/1982 | Tse | 160/259 |

*Primary Examiner*—Ramon S. Britts
*Assistant Examiner*—Cherney S. Lieberman
*Attorney, Agent, or Firm*—Alfons Puishes

[57] ABSTRACT

This invention is an improvement over my U.S. Pat. No. 4,326,577 for a window screen arrangement comprising a novel roller combination for winding and unwinding the screen or shade element and at the same time positioning of the entire screen assembly in a desired position vertically on a window to provide partial screening in any part of the window while at the same time permitting additional screening provided by the operation of the screen upon a roller. The method of supporting the screen in the window opening comprises a novel arrangement of cords for support and positioning which permit the foregoing without the use of pulleys, springs, counter-weights, hooks, clamps or other positioning devices to hold the screen assembly in any given location by permitting its roller features to function. The arrangement used here entails the use of only two instead of four cords as in my previous invention and by means of the novel continuous arrangement of the cords it simplifies the construction and permits positioning of the rollers at an angle to the window frame from the horizontal. I also provide a novel method of fastening the screen upon the rollers.

4 Claims, 8 Drawing Figures

VERTICALLY POSITIONING WINDOW SHADING SYSTEM

BACKGROUND OF THE INVENTION

The basic idea of positioning a roller type of window screen vertically in a window frame to change its effective area of screening is old in the art. Various devices have been patented and those known to the applicant at the time which are considered to be the closest prior art are summarized briefly below.

Thiel, U.S. Pat. No. 394,737 utilizes an ordinary roll-up type of window shade and instead of mounting it at the top of the window opening provides for its riding on guide rods at the sides of the window with a pulley and rope arrangement to raise and lower the screen roller to any desired position.

Brown, U.S. Pat. No. 938,207 teaches the use of angle iron brackets at the sides of the window providing rails from which L-shaped plates are permitted to ride, said plates holding the roller in position which may be altered by the use of suitable rope and pulley arrangements mounted on the window frame and attached to the sliding slide plates holding the roller.

Joseph, U.S. Pat. No. 1,303,678 teaches the use of horizontal metal slats to hold the screen roller which are positioned vertically in the window screen by means of chain and sprocket combinations, provisions being made to hold the chain in a given and consequently provide for changing the location of the roller.

Heck, U.S. Pat. No. 4,202,395 utilizes vertically movable bars with zig-zag panels in between, the bars being changeable in location by means of parallel cords which in turn cause the bars to act on the slats after the manner somewhat of a venetian blind. The cord arrangement is of parallelogram configuration and is very different from the arrangement of applicant.

Hopkins, U.S. Pat. No. 785,806 uses a hollow roller through which cords pass connecting with sliding crossheads moving in vertical grooves which hold the roller and hence the shade in a proper horizontal position.

My U.S. Pat. No. 4,326,577 utilizes hollow rollers and tension cords so arranged in or upon a window frame as to remain in tension at all times and hold the rollers in any given desired position because of their novel method of threading through the rollers and attaching to the frame. In that invention I use two sets of cords of two each or a total of four which somewhat complicates the tension adjustment of the cords.

SUMMARY OF THE INVENTION

My new and improved screen and roller combination, as my previous invention, departs from the traditional screen arrangement using two rollers from which the connecting screen is rolled and unrolled to change the area of screening. The rollers and hence the screen is supported in any desired position by a novel and improved cord arrangement which permits the entire screen to be raised and lowered by changing the position of the upper roller and the screen opening is altered by rotation of the lower roller without the necessity of any positioning devices such as pulleys, chains, ropes or springs. My novel and improved construction provides for the support cords to be threaded through the rollers and over and around the window frame back to anchor positions at the base of the window maintaining tension on the cords and hence holding the rollers in any given position, including a position at an angle to the horizontal.

I have also invented a novel method of holding the screen to the roller and permitting ready removal for cleaning, etc.

DESCRIPTION OF A PREFERRED EMBODIMENT

Figure 1A:
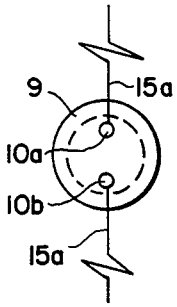
FIG. 1A is one end view of roll 3 showing cord holes.
Figure 1B:
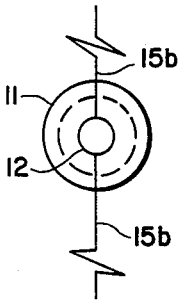
FIG. 1B is one end view of roll 4 showing cord hole.
Figure 1:
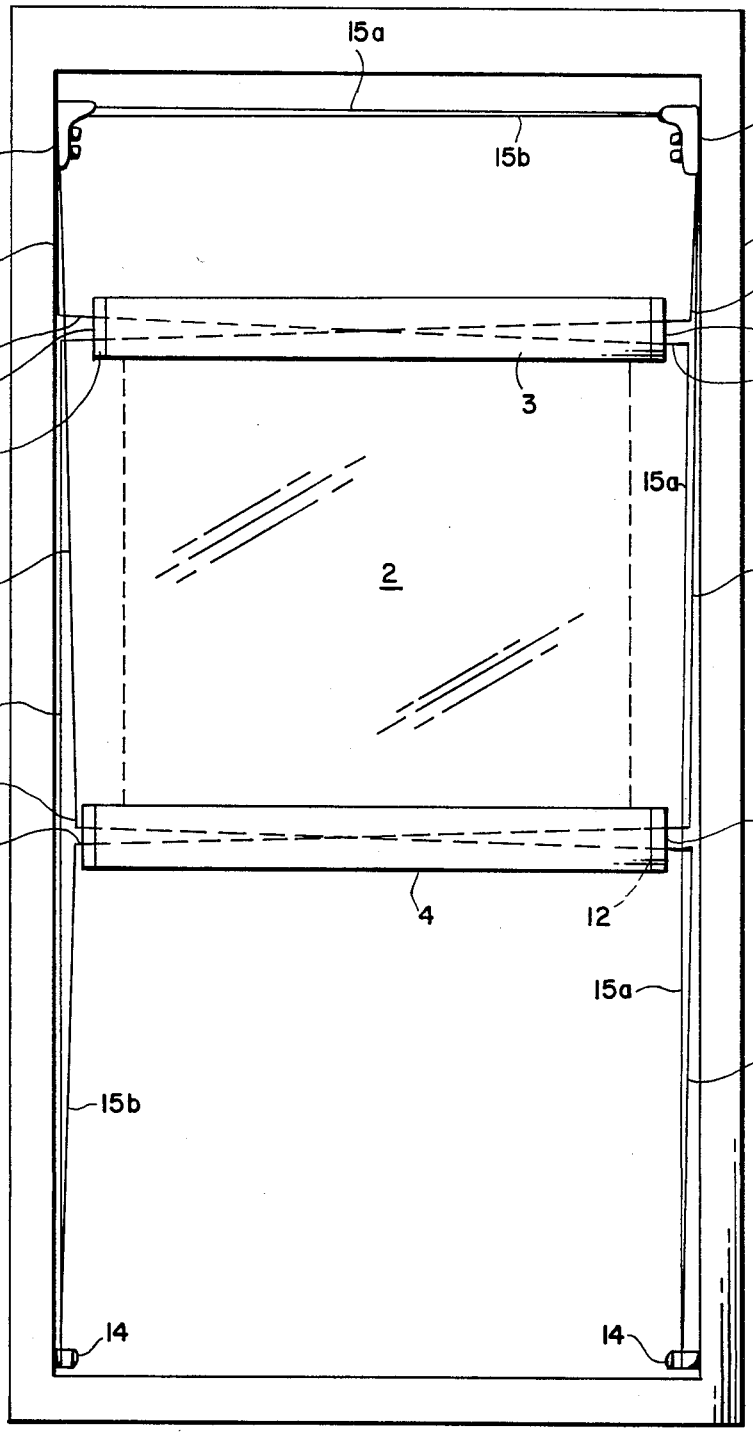
FIG. 1 is a front elevation of a window frame showing my system installed inside the frame.

Referring now to the figures and especially first to FIG. 1, there is seen a typical window frame 1, a screen 2, the hollow upper non-rotatable roller 3 of my system and the hollow lower rotating roller 4. The ends of screen 2 may be fastened to rollers 3 and 4 respectively by any suitable means such as "Velcro" fasteners or by the preferred method which I describe below and is illustrated on FIG. 6.

At the ends of roller 3 are positioned knobs or caps 9 which form a part thereof. In each of knobs or caps 9 there is drilled an upper hole **10*a* and a lower hole 10*b*, the function of which is set forth below. On roller No. 4 are positioned knobs or caps 11 at the ends thereof on which are drilled concentric holes 12 whose function is also set forth below. Angle brackets or hooks 13*c* in FIG. 1 or 13*b* in FIG. 3, which are shown in greater detail on FIG. 4 and FIG. 5 respectively, are positioned at the top of the frame for passage and holding of the cords. The ends of the cords are secured by any suitable fastening means at the bottom of the frame as shown at anchors 14**.

Figure 2:
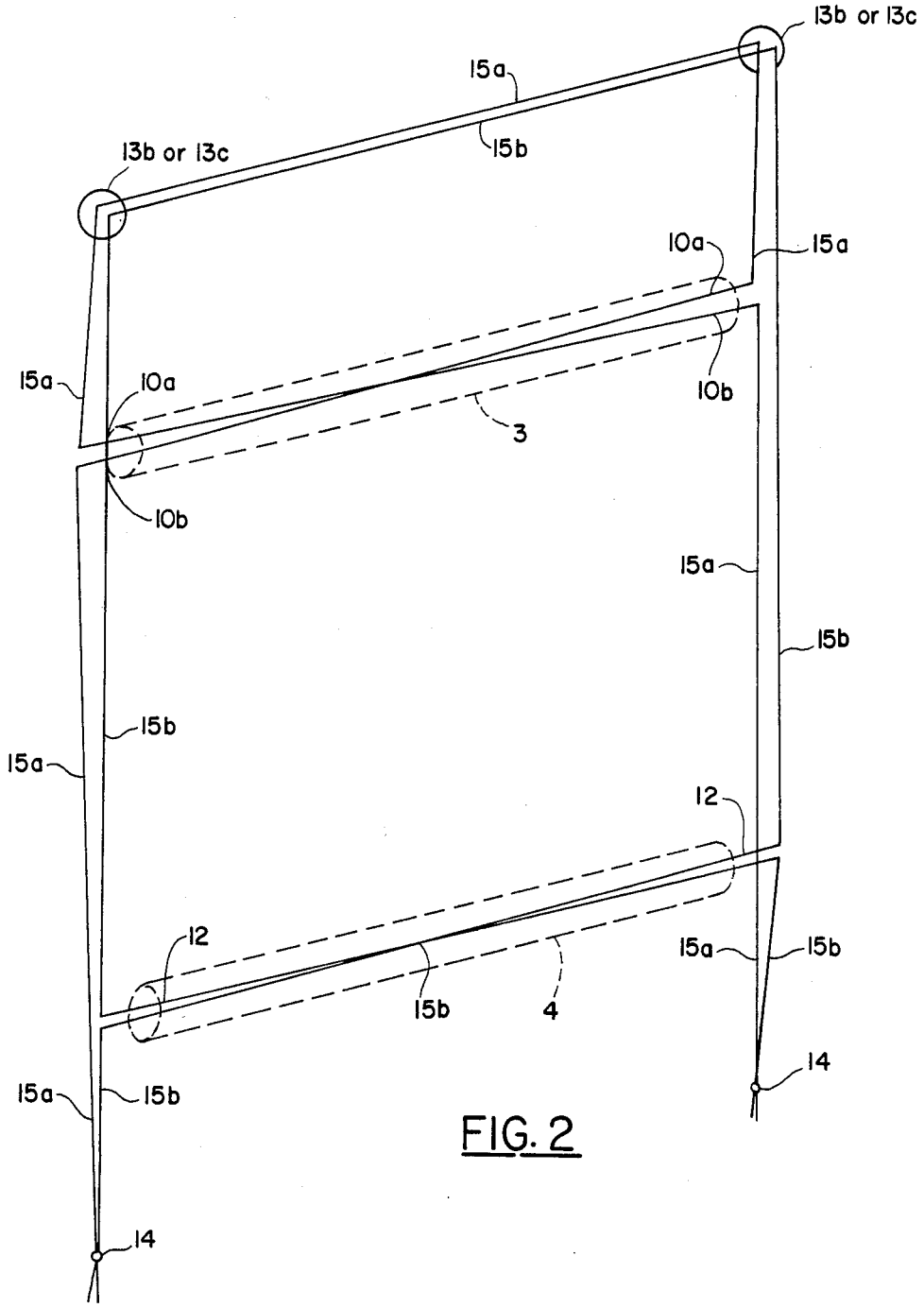
FIG. 2 is a schematic diagram for better understanding of the improved method of installing my cords which comprise the heart of the operating system.
Figure 3:
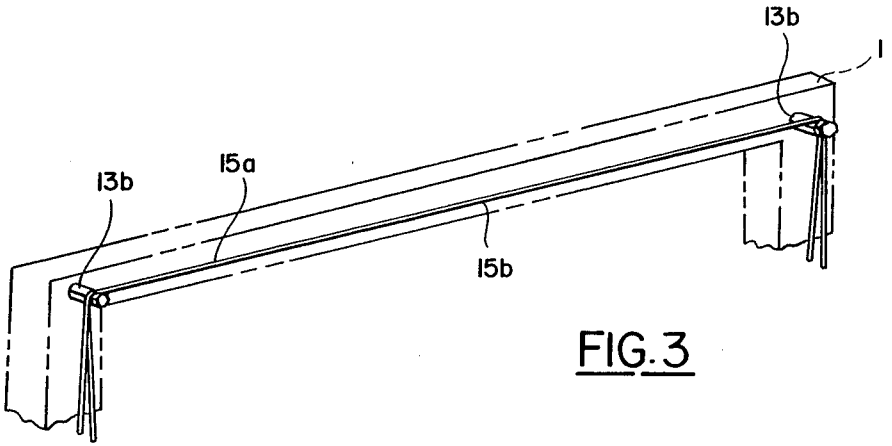
FIG. 3 is a partial isometric showing the top of a window frame with my improved system installed on its outer face.

Attention should now be had to FIG. 1, FIG. 1A and FIG. 1B in conjunction with FIG. 2 to understand the method of installing my operating cords. In this improved embodiment I use two separate cords designated as **15*a* and 15*b*. Starting first with cords 15*a* from its right side anchor point 14 on FIG. 1 and FIG. 2, this cord rises vertically to lower hole 10*b* in the right end of knob 9 of roller 3. It then passes through the interior of this roller and out the opposite end through the upper hole 10*a* on the left end of roller 3 and then upwards to the angle bracket or turning knob, as the case may be 13*b*** or *c*, depending on whether the inside construction of FIG. 1 or the face construction of FIG. 3 is used. It then proceeds horizontally across the top of the window frame 1 to the opposite side and around the opposite angle bracket or knob **13*b*** or *c* downwards to the upper right end hole **10*a* in knob 9 on roller 3. It then passes through the interior of this roller and out through the lower hole 10***b* on the opposite or left end and thence downwards to the opposite or left side anchor point 14 at the bottom of the window frame, opposite to its starting point.

Now turning our attention to the second cord designated as 15*b*, it also starts from right side anchor point 14 and goes upwards to right end concentric hole 12 in knob 11 through roller 4 and out the opposite or left end through concentric hole 12 on the opposite end of roller 4 and thence upwards to turning bracket or knob 13*b* or *c*, thence horizontally to the corresponding turning knob or bracket on the opposite or right side of the window frame, thence downward again to right end concentric hole 12 in knob 11 through roller 4, out of the opposite end of roller 4 through concentric hole 12 and back down to left side anchor point 14. The anchor means 14 serve to hold the tension on the cords.

It is thus seen that with this improved embodiment I need use only two cords which simplifies the matter of maintaining proper tension. Because of the essentially single cord arrangement of 15*a*, I am able to tilt roller 3 at any angle desired from the horizontal and still maintain tension on the cords.

Figure 4:
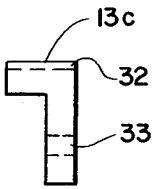
FIG. 4 is an end view of the angle bracket for turning and holding the cords when used inside the frame as in FIG. 1.

Looking at FIG. 4 there is seen the angle bracket of 13*c* of FIG. 1 having holes 33 for fastening to the window frame 1 and a slot 32 for passage of the cords. This is used with the inside of window frame construction shown in FIG. 1.

Figure 5:
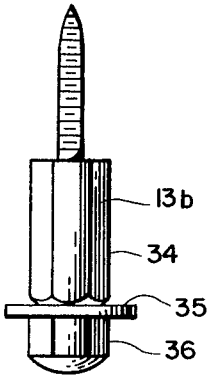
FIG. 5 shows the adjustable knob for turning and holding the cords when the system is installed on the face of a window frame as in FIG. 3.

In FIG. 5 there is seen a detail of my knob 13*b* of FIG. 3 which is screwed into the face of the window frame as shown by means of hex nut 34. Washer 35 and acorn nut 36 serve to hold the cords in fixed position when proper tension has been established. This is used when the face of window frame construction shown in FIG. 3 is utilized.

Figure 6:
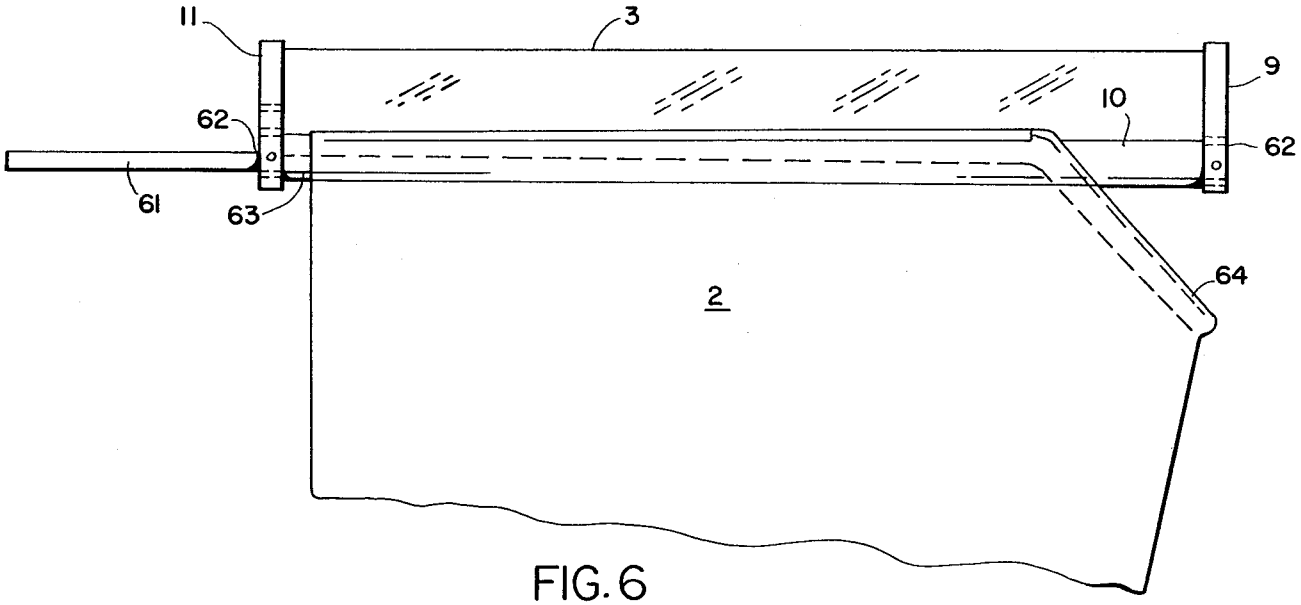
FIG. 6 shows a roller with my improved method of fastening the screen to the roller.

Referring now to FIG. 6 there is seen one of my rollers, either 3 or 4, with their corresponding knobs 9 or 11 respectively positioned on the ends thereof. In this embodiment these knobs are equipped with additional holes 62. The rollers in this case are equipped with a longitudinal slot 63 throughout their length positioned opposite to and between holes 62. My screen 2 is made with a hem 64 to accommodate a sliding rod 61. With this embodiment I insert my hemmed end 64 of screen 2 into slot 63 and then insert rod 61 through the hem of screen 2 through its entire length and then out the holes 62 at opposite ends of the rollers. This serves to offer a positive engagement between the edge of screen 2 and the rollers 3 and 4 and at the same time makes it readily removable for washing or cleaning of the screen 2.

OPERATION

The operation of my system is essentially the same as that in my previous application Ser. No. 140,694 now U.S. Pat. No. 4,326,577. Upper roller 3 is placed in the highest possible position in window frame 1 by merely physically moving the roller upwards with the motion of translation, the cords 15*a* sliding through the hollow interior of roller 3 while maintaining tension throughout the system. Screen 2 is then attached to roller 3 by any suitable means mentioned above, preferably the one illustrated on FIG. 6. Screen 2 is then stretched out its full length and its lower edge engaged on rotating roller 4, also by means of suitable fastening means as described above. To change the effective screen length of screen 2, bottom roller is then merely rotated by hand causing the screen to wind up upon its perimeter. When thus shortening the screen, the roller 4 will move upwards and the cords 15*b* being concentric will permit this movement upwards along the length of the cords while maintaining tension against the anchors 14. Any desired amount of screening may be obtained depending upon how much the screen is rolled up on roller 4.

To position the screening area vertically in the window opening in order to locate the effecting screening area in the desired elevation, roller 3 is grasped and is physically moved upwards and downwards with a motion of translation. In this case cord 15*a* passing through holes 10*a* and 10*b* and a hollow interior roller 3 slides through the roller and maintains its position because of the tension and friction of the cord brought about by its passage through the hollow interior of roller 3 and the tension maintained by anchors 14. In this manner any desired amount of window area may be screened and the location of the screened area positioned vertically at any desirable point, the rollers 3 and 4 being maintained in position by the action of the cords.

The effectiveness and simplicity of operation of my system and its construction are now evident, as well as its novelty and superiority over the prior art through the absence of elaborate systems of pulleys, ropes, springs and other devices as set forth above, all of which I eliminate.

I claim:

1. An improved vertically positioning window shading system for a window frame comprising:

a first upper hollow non-rotating horizontal roller;

a second lower hollow rotating roller parallel to said first roller;

a vertical screen having one of its parallel horizontal edges fixedly positioned upon said first roller and its opposite edge fixedly positioned on said second roller;

a first cord means having its ends fixedly positioned on opposite sides of the lower edge of a window frame;

said first cord means being disposed to suspend said first roller through its hollow center while permitting a vertical movement of translation of said first roller along said cord;

a second cord means having its ends fixedly positioned on the opposite sides of the lower edge of said window frame;

said second cord means being disposed to suspend said second roller through its hollow center while permitting a combined movement of rotation and translation of said second roller;

said first roller being equipped with caps at each end, each of said caps having a pair of holes positioned one above the other drilled through them;

said second roller being equipped with caps at each end, each of said caps having a hole drilled through it concentric to said roller;

said first cord means passing from one side of said lower edge of said window frame upwardly to the lower hole in the first end of said roller on the same side of said frame as said first end thence in turn through the lower of said holes in the first end of said first roller, thence through the interior of said first roller, thence through the upper of said holes in a second end of said first roller, thence vertically upwards to the top of said window frame to a first holding means positioned thereon, thence horizontally across the top of said window frame to a second holding member positioned thereon, thence vertically downward to the upper of said holes in said first end of said first roller, thence through the interior of said first roller, thence through the lower of said holes in said second end of said first roller, thence vertically downward to the opposite side of said lower edge;

said second cord means passing in turn from one side of said lower edge of said window in turn through the concentric hole in the first end of said second roller on the same side of said frame as said first end thence, through the interior of said second roller through the concentric hole in a second end of said second roller, thence vertically upwards to the top of said window frame to said first holding member, thence horizontally across the top of said window frame to said second holding member, thence vertically downwards to said concentric hole in said first end of said second roller, thence through the interior of said second roller through said concentric hole in said second end of said second roller, thence vertically downwards to the opposite side of said lower edge.

2. The system of claim 1 in which the effective area of said screen may be modified by manually rotating said second roller about said cord means and causing said screen to roll up on said roller.

3. The system of claim 1 in which the vertical position of said screen upon said window may be modified by manually raising or lowering said non-rotatable roller laterally along said cord means.

4. The system of claim 1 or claim 2 or claim 3 in which said screen is fastened to said rollers by means of:

a longitudinal slot through the length of said rollers;

holes through each of said caps in alignment with each other and with said slot;

a hem in the edge of said screen providing an opening along the edge of said screen;

said hem being inserted in said slot;

a cylindrical rod disposed for passing through said holes and said hem;

thereby securing said screen to said rollers.

* * * * *